United States Patent [19]

Cartledge et al.

[11] 4,230,370

[45] Oct. 28, 1980

[54] EQUIPMENT FOR LAYING ELONGATE MATERIAL

[75] Inventors: Brian W. Cartledge, Codnor; Barry Millhouse, Stonebroom; Michael E. Cheese, Underwood, all of England

[73] Assignee: Coal Industry (Patents) Limited, London, England

[21] Appl. No.: 2,643

[22] Filed: Jan. 11, 1979

[30] Foreign Application Priority Data

Feb. 28, 1978 [GB] United Kingdom ..... 07869/78

[51] Int. Cl.[2] ..... E21C 35/20; E21D 19/02

[52] U.S. Cl. ..... 299/33; 299/43; 405/150; 242/86.52

[58] Field of Search ..... 299/11, 33, 43, 45; 405/150, 288; 242/86.52, 86.6

[56] References Cited

U.S. PATENT DOCUMENTS

| | | | |
|---|---|---|---|
| 3,399,927 | 9/1968 | Groetschel | 299/11 |
| 4,099,785 | 7/1978 | Groetschel | 299/33 X |
| 4,122,682 | 10/1978 | Groetschel | 405/150 |

FOREIGN PATENT DOCUMENTS

| | | | |
|---|---|---|---|
| 2655511 | 6/1978 | Fed. Rep. of Germany | 299/11 |

*Primary Examiner*—Ernest R. Purser

*Attorney, Agent, or Firm*—James Creighton Wray

[57] ABSTRACT

Equipment for laying a layer of elongate material adjacent to a newly exposed rock or mineral surface in an underground mine which is formed by a mining machine cutter as the machine traverses along a working face comprising a support bracket secured to the mining machine and defining a slideway along which a slide member can slide in a direction transverse to the direction of machine traverse, the slide member being provided with support arm means for supporting a coil of elongate material.

10 Claims, 2 Drawing Figures

EQUIPMENT FOR LAYING ELONGATE MATERIAL

Figure 1:
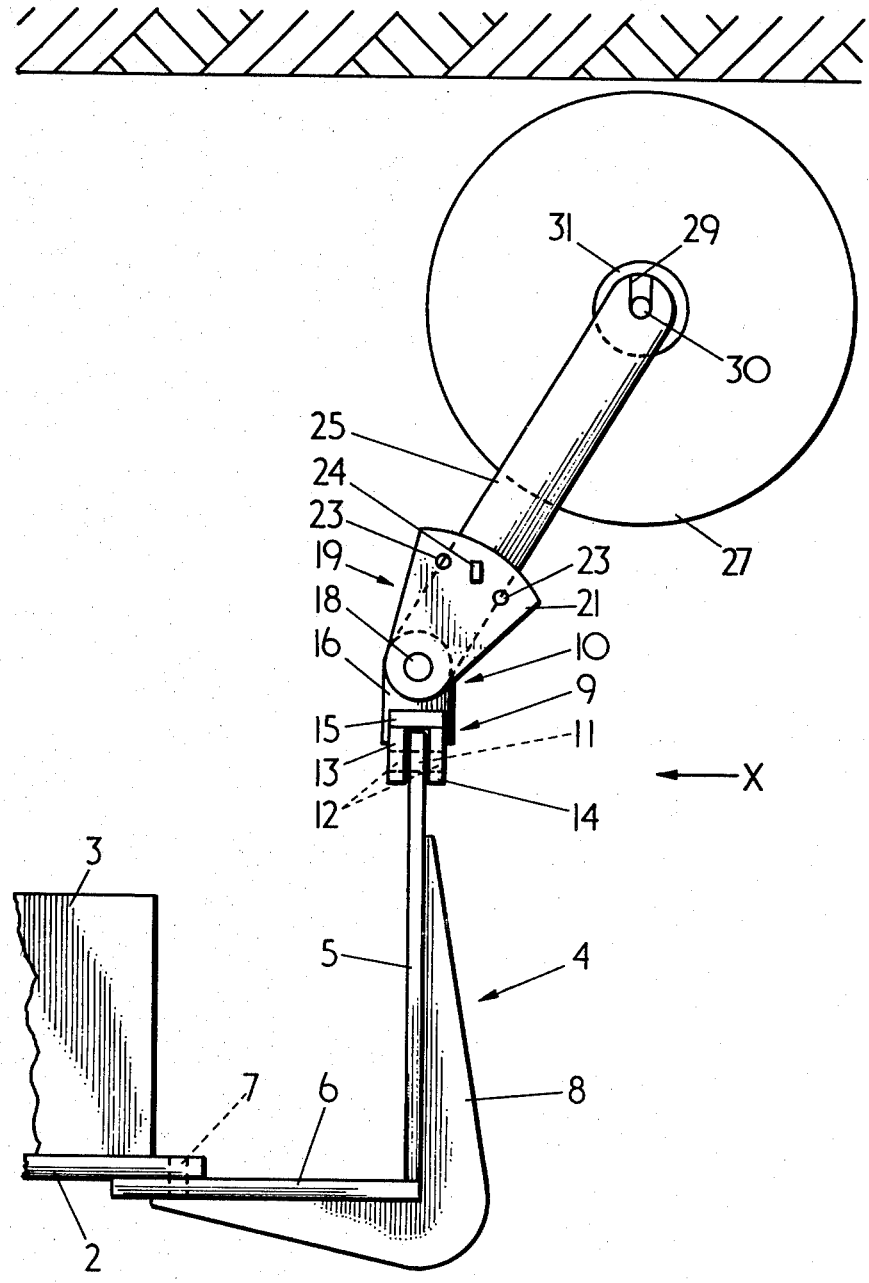

This invention relates to equipment for laying a layer of elongate material, for example, wire mesh or wire mesh with a sheet backing adjacent to an exposed rock or mineral surface in an underground mine.

In particular, the present invention relates to such equipment securable to a mining machine including a cutter for cutting rock or mineral from a working face, the equipment laying the layer of elongate material adjacent ot the rock or mineral surface newly exposed by the cutter as it traverses along the working face.

Previously, it has been proposed to mount equipment for laying a layer of wire mesh adjacent to an exposed mine roof on the body of the mining machine, the equipment being cantilevered from the body of the machine into the formed track left directly behind the cutter. The equipment comprised storage means for a coil of elongate material which, in use, as the machine traverses along the working face is uncoiled, and guide roller means for guiding the material unwinding from the coil into contact with the mine roof. Unfortunately, such prior known equipment tended to be complicated to operate and liable to be easily damaged. Consequently, it never found wide favour and was never widely exploited.

An object of the present invention is to provide equipment for laying a layer of elongate material adjacent to an exposed mine roof which tends to be simple and robust and which tends to overcome or reduce the above mentioned disadvantage.

According to the present invention, equipment for laying a layer of elongate material adjacent to a newly exposed rock or mineral surface formed by a mining machine cutter as the machine traverses along a working face, comprises a support bracket for fixed attachment to the mining machine, the support bracket providing a horizontally extending slideway, a slide component slidable along the slideway for movement transverse to the direction of machine traverse, securing means for fixing the position of the slide component along the slideway, support arm means extending from the slide component, the support arm means constituting storage means for a coil of elongate material such that in use as the machine traverses along the working face the elongate material is unwound from the coil and laid adjacent to the newly exposed rock or mineral surface.

Preferably, the support arm means are pivotally mounted on the slide component for movement about a horizontally extending axis.

Advantageously, means are provided to retain the support arm means at a desired angular position relative to the slide component.

Alternatively, resilient means are provided to urge the support arm means towards the newly exposed rock or mineral surface.

Preferably, the support bracket comprises an upstanding plate and the horizontally extending slideway is constituted by a horizontally extending edge margin of the plate.

Conveniently, the slide component comprises a generally inverted trough shaped formation adapted to slidably engage the horizontally extending edge margin, the limbs of the inverted trough shaped formation being arranged on opposite sides of the upstanding plate.

Conveniently, the slide component is provided with a series of bolt holes alignable in sequence as the slide component is slid along the slideway with at least one bolt hole on the upstanding plate, and in which case the securing means comprises at least one bolt engagable in aligned bolt holes.

Advantageously, the upstanding plate has a plurality of holes alignable with the series of bolt holes on the slide component.

Preferably, the support arm means comprises two spaced arms for supporting the ends of an axle upon which the coil of elongate material is mounted.

Conveniently, the upstanding plate of the support bracket constitutes one limb of a generally 'L' shaped formation, the other limb being adapted for connection to a support underframe of the mining machine.

Figure 2:
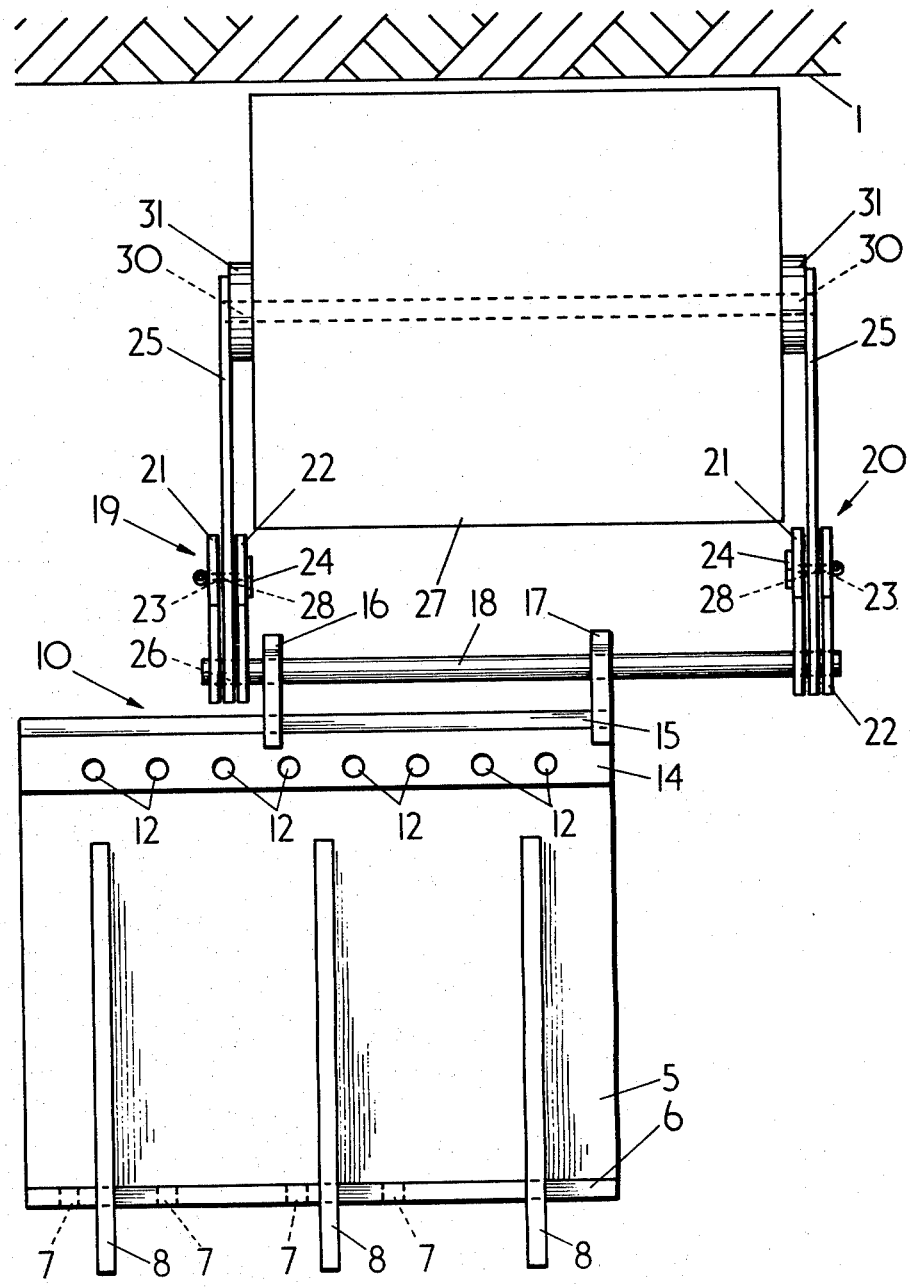

By way of example only, one embodiment of the present invention will now be described with reference to the accompanying drawings, in which:

FIG. 1 is a side elevation of equipment for laying a layer of elongate material, for example, wire mesh, adjacent to an exposed mine roof, the equipment being shown in an operational position and being constructed in accordance with the present invention; and FIG. 2 is a rear end view of the equipment of FIG. 1.

The drawings show equipment for laying a layer of elongate material, for example, wire mesh or wire mesh with a sheet backing adjacent to an exposed rock or mineral mine roof surface 1 in an underground mine. The equipment is attached to a support underframe 2 of a well known shearer mining machine 3 (only one end of which is shown in FIG. 1) which has a rotary cutter (not shown) arranged to cut rock or mineral from a working face as the machine traverses along the working face in a direction indicated by arrow X in FIG. 1. The cut rock or mineral is urged by the rotating cutter towards a conveyor (not shown) extending along the working face. As the machine traversed along the face the equipment lays a layer of wire mesh adjacent to the mine roof, the wire mesh being retained adjacent to the mine roof by roof supports which are advanced and set to the mine roof immediately following the passage of the machine.

The equipment for laying the layer of wire mesh comprises a support bracket 4 including a generally 'L' shaped plate formation having an upstanding limb 5 and a horizontally extending limb 6 secured to the support underframe 2 by bolts (not shown) located in bolt holes 7. The two plates constituting the limbs 5 and 6 are retained in position by strengthening lugs 8.

The uppermost horizontally extending edge margin of the plate 5 constitutes a slideway 9 along which a slide component 10 is slidable in a direction transverse to the direction of machine travel. The uppermost edge margin is provided with bolt holes 11 alignable in sequence with at least one pair of aligned bolt holes of a series of pairs of aligned bolt holes 12 provided in the slide component 10. Thus, in use, once the slide component 10 is slid along the slideway 9 to a desired position it is retained in the desired position by at least one bolt (not shown) located in aligned bolt holes 11 and 12.

The slide component 10 comprises an elongated generally inverted trough shaped formation having limbs 13 and 14 each provided with a series of the previously mentioned bolt holes 12 and an upper cross member 15 connecting the two limbs. The inverted trough shaped formation is arranged to slide along the horizontally extending slideway 9 with the limbs 13 and 14 arranged on opposite sides of the upstanding plate 5.

The slide component 10 also comprises two upstanding members 16 and 17 fixedly secured to the inverted trough shaped formation and bridging the limbs 13 and 14 and the cross member 15. The two upstanding members 16 and 17 fixedly carry a horizontally extending rod 18 which, in turn, supports at its ends support arm means constituted by two upwardly extending arm assemblies 19 and 20, the arm means providing storage means for a coil 27 of elongate material, for example wire mesh.

Each arm assembly 19 or 20 comprises two spaced upwardly extending generally fan shaped elements 21, 22 fixedly secured to the associated member 16 or 17 and each provided with a series of pin holes 23 angularly spaced around the axis of the rod 18 and selectively engaged by a pin 24 as will be explained later in this specification.

Each arm assembly 19 or 20 also comprises an upwardly extending arm component 25 which is located between the two associated fan shaped elements 21 and 22 and which has a hole 26 rotatably mounted on the rod 18 permitting pivotal movement of the arm component about the axis of the rod 18, the arm component having a pin hole 28 engageable by the previously mentioned pin 24 to retain the arm component in a selected raised position relative to the slide component 10.

The upper end margin of each arm component 25 is provided with a vertically extending slot 29 for accommodating the ends of an axle 30 rotatably supporting the coil 27. Spacers 31 are provided to ensure the coil does not foul the arm component 25.

In use, before the machine starts its traverse along the working face the storage means is loaded by removing the pins 24 to permit the arm components 25 to be lowered and locating the axle 30 of a coil 27 of wire mesh in the slots 29. The arm components 25 are then raised until the wire mesh adjacent to the circumference of the coil 27 is adjacent to the mine roof 1. The pins 24 are then located in the appropriate desired holes 23, 28 to retain the arm components in the desired raised positions. Thus, as the machine starts its cutting traverse along the working face with the rotary cutter winning mineral to expose the mine roof 1 elongate material, for example, wire mesh, is unwound from the coil 27 and laid adjacent to the mine roof where it is supported by newly advanced mine roof supports and/or is attached along one edge to the next adjacent layer of material which was laid on an earlier traverse of the machine along the face.

When the machine reaches the end of the working face the elongate material is cut and the remaining coil of elongate material is removed from the storage means to thereby allow the machine to traverse along the working face in the opposite direction. Once the machine has completed its traverse in the opposite direction the storage means is reloaded with a new coil 27 and the next layer of elongate material is laid adjacent to the mine roof. The whole procedure is then repeated.

From the above description it will be appreciated that the present invention provides simple convenient and robust equipment for laying a layer of elongate material along a newly exposed mine roof so that an effectively continuous curtain of, for example, wire mesh or wire mesh with a sheet backing is provided over the mine roof. Thus friable mine roof tends to be contained and broken rock or mineral tends to be prevented from falling into the travelling passage defined by the roof supports.

In an alternative embodiment of the present invention, the arm components 25 are resiliently urged towards the mine roof.

We claim:

1. Equipment for laying a layer of elongate material adjacent to a newly exposed rock or mineral surface formed by a mining machine cutter as the machine traverses along a working face, comprising a support bracket for fixed attachment to the mining machine, the support bracket providing a horizontally extending slideway, a slide component slidable along the slideway for movement transverse to the direction of machine traverse, securing means for fixing the position of the slide component along the slideway, support arm means extending from the slide component, the support arm means constituting storage means for a coil of elongate material such that in use as the machine traverses along the working face the elongate material is unwound from the coil and laid adjacent to the newly exposed rock or mineral surface.

2. Equipment as claimed in claim 1, in which the support arm means are pivotally mounted on the slide component for movement about a horizontally extending axis.

3. Equipment as claimed in claim 2, in which means are provided to retain the support arm means at a desired angular position relative to the slide component.

4. Equipment as claimed in claim 2, in which resilient means are provided to urge the support arm means towards the newly exposed rock or mineral surface.

5. Equipment as claimed in claim 4, in which the support bracket comprises an upstanding plate and the horizontally extending slideway is constituted by a horizontally extending edge margin of the plate.

6. Equipment as claimed in claim 5, in which the slide component comprises a generally inverted trough shaped formation adapted to slidably engage the horizontally extending edge margin, the limbs of the inverted trough shaped formation being arranged on opposite sides of the upstanding plate.

7. Equipment as claimed in claim 6, in which the slide component is provided with a series of bolt holes alignable in sequence as the slide component is slid along the slideway with at least one bolt hole on the upstanding plate, and in which case the securing means comprises at least one bolt engagable in aligned bolt holes.

8. Equipment as claimed in claim 7, in which the upstanding plate has a plurality of holes alignable with the series of bolt holes on the slide component.

9. Equipment as claimed in claim 8, in which the support arm means comprises two spaced arms for supporting the ends of an axle upon which the coil of elongate material is mounted.

10. Equipment as claimed in claim 9, in which the upstanding plate of the support bracket constitutes one limb of a generally 'L' shaped formation, the other limb being adapted for connection to a support underframe of the mining machine.

* * * * *